US007185398B2

(12) United States Patent
Kral

(10) Patent No.: US 7,185,398 B2
(45) Date of Patent: Mar. 6, 2007

(54) MECHANICAL DOOR CLOSER

(76) Inventor: Joseph Michael Kral, 30 Ramsay Road, Five Dock, NSW 2046 (AU)

( * ) Notice: Subject to any disclaimer, the term of this patent is extended or adjusted under 35 U.S.C. 154(b) by 164 days.

(21) Appl. No.: 10/501,264

(22) PCT Filed: Dec. 4, 2002

(86) PCT No.: PCT/AU02/01639

§ 371 (c)(1),
(2), (4) Date: Jan. 14, 2005

(87) PCT Pub. No.: WO03/062573

PCT Pub. Date: Jul. 31, 2003

(65) Prior Publication Data

US 2005/0125947 A1 Jun. 16, 2005

(30) Foreign Application Priority Data

Jan. 18, 2002 (AU) ..... PS0014

(51) Int. Cl.
*E05F 1/08* (2006.01)

(52) U.S. Cl. ..... 16/72; 16/80; 16/49; 16/71

(58) Field of Classification Search ..... 16/72, 16/71, 70, 49, 65, 80, 82, 197, 329, 330; 292/270–275, 278; 160/371; 49/160, 139, 49/199, 346, 366
See application file for complete search history.

(56) References Cited

U.S. PATENT DOCUMENTS 2,277,316 A * 3/1942 Garrison ..... 292/274
2,744,779 A * 5/1956 Ellis ..... 292/278
3,164,404 A * 1/1965 Arnold ..... 292/273
3,630,560 A * 12/1971 Atkins et al. ..... 292/270
4,751,766 A * 6/1988 Fahs et al. ..... 16/332
4,837,890 A * 6/1989 Tully et al. ..... 16/71
4,858,272 A * 8/1989 Ogawa et al. ..... 16/80
5,381,628 A * 1/1995 D'Hooge ..... 49/394
5,829,508 A * 11/1998 DeBower et al. ..... 160/371
5,901,992 A * 5/1999 Winkler ..... 292/270
5,906,026 A * 5/1999 Junttila ..... 16/85
6,253,417 B1 * 7/2001 Rusiana ..... 16/82
6,557,301 B1 * 5/2003 Hormann et al. ..... 49/139
6,684,455 B1 * 2/2004 Mertin ..... 16/334

FOREIGN PATENT DOCUMENTS

DE 4426430 A1 * 2/1996
DE 19618834 A1 * 11/1996
EP 0 635 613 1/1995
EP 0 740 040 10/1996
EP 0 790 381 8/1997
JP 10131602 A * 5/1998

* cited by examiner

*Primary Examiner*—Chuck Y. Mah
(74) *Attorney, Agent, or Firm*—Ladas and Parry LLP

(57) ABSTRACT

A mechanical door closer (10) that includes a spring (20) mounted in a track (13) to urge the door (11) to a closed position. A brake assembly (24) controls that rate at which the door (11) closes. The brake assembly (24) includes a brake hub (25) that has ramp slots (32) that receive balls (33) that engage a braking shell (34) to cause the braking assembly (24) to frictionally engage the track (13) to thereby control movement of the door (11).

20 Claims, 6 Drawing Sheets

MECHANICAL DOOR CLOSER

TECHNICAL FIELD

The present invention relates to door closers.

BACKGROUND OF THE INVENTION

Present door closer incorporate pneumatic or hydraulic means to control the momentum of the door.

Pneumatically controlled door closers have a limited life due to a lack of continuous or repeated lubrication to cylinders and piston seals.

Hydraulically controlled door closers are well lubricated, last longer than the pneumatically controlled door closers, however, when the seals wear out, the piston soon jams within the cylinder and the door is totally inoperable and, if force is applied to the door, the door may be unhinged, causing substantial damage to the door and the door jamb. In addition, the leaking hydraulic fluid damages the surrounding door and floor finishes and, in case of fire, the hydraulically controlled door closers may explode thus is adding to the peril.

All presently available door closers require a substantial force to operate them. The very young, elderly or disabled persons may not be able to operate doors fitted with these door closers.

OBJECT OF THE INVENTION

It is the object of the present invention to overcome or substantially ameliorate at least one of the above disadvantages.

SUMMARY OF THE INVENTION

There is disclosed herein a mechanical door closer to extend between a door and an associated door jamb to urge the door to a closed position with respect to the door jamb, said closer including:

an elongated track to be fixed to the door or doorjamb;

a carriage mounted on the track for movement there along;

a connecting member attached to the carriage and extending therefrom to attach the carriage to the door jamb if the track is attached to the door, or to attach the carriage to the door if the track is attached to the door jamb, so that movement of the door in a closing direction causes movement of the carriage in a predetermined direction;

a biasing member urging said carriage to move in said predetermined direction along the track and wherein said track and connecting member are intended to be attached to the door and door jamb so that upon opening movement of the door said carriage is caused to move along said track in a direction opposite said predetermined direction; and wherein said carriage includes a brake mechanism to restrain movement of said carriage in said predetermined direction, said brake mechanism having:

a first brake part, said first part being mounted for rotational movement about an axis transverse of said track and having at least one ramp surface extending angularly and axially with respect to said axis, said first part being engaged with said track to cause rotation of said first part in a predetermined angular direction when said carriage is moved in said predetermined direction along said track;

a rotatable element engaged with said ramp surface;

a second brake part, said second part being mounted adjacent said first part and having a surface to engage said element;

a brake surface; and wherein relative angular movement between the first and second parts by rotation of said first part in said predetermined angular directions causes said element to move along said ramp surface to separate the first and second parts axially and move said brake surface against an adjacent surface so that a friction force is applied to said brake surface to restrain movement of said carriage in said predetermined direction.

Preferably said second brake part retains said element in position with respect to said ramp surface.

Preferably said first part has a plurality of ramp surfaces, and a rotatable element engaged with each ramp surface and said second part surface to cause the separation of the first and second parts.

Preferably each ramp surface also extends radially relative to said axis.

Preferably each ramp surface is inclined to said axis by an angle, said angle being between 12° and 20°.

Preferably said angle is about 16°.

Preferably said track is adapted to be attached to said door and said connecting member is an arm, said arm being pivotally attached to said carriage, and adaptably to be pivotally attached to said jamb for pivoting movement about an arm axis.

Preferably said biasing member is a spring that is tensioned upon movement of said carriage in said opposite direction.

Preferably said spring is elongated and has a first extremity attached to said track and a second extremity attached to said carriage.

Preferably said track has a longitudinally extending slot defined between first part engaging longitudinal surfaces, and said first part has a generally cylindrical portion positioned to engage said longitudinal surfaces so that upon engagement of said cylindrical portion with a first one of said longitudinally extending surfaces said first part is caused to rotate in said predetermined angular direction.

Preferably said first part has said brake surface and said carriage includes a brake member providing a further brake surface, with said brake member being operatively associated with said second part so that upon separating movement of said first and second parts the brake surfaces are urged into friction engagement with said track.

Preferably said second brake surface is located internally of said track and said first brake surface is located externally of said track.

Preferably said carriage includes an axle member securing the carriage to said arm and upon which said second and first parts are mounted for angular movement thereabout, with said axle member providing said axis.

In an alternative embodiment said door closer is adapted to be attached to a sliding door, said track is to be fixed to the door jamb and said carriage includes a roller fixed to the first brake parts to cause the rotation thereof, and engaged within said track, and said connecting member is adapted to be attached to said door so that the door is supported on said roller.

Preferably said roller is part of said first part.

In a further preferred form said biasing member is a spring operatively associated with said arm to urge said arm to move said carriage in said first direction.

In a further preferred form said spring is a coil spring.

In a further preferred form said spring is a spiral spring.

Preferably the door closer further includes:

a lever fixed to said arm so as to pivot therewith about said arm axis, and wherein said spring is an elongated coil spring and said lever has an arcuate spring engaging surface from which said spring extends, which surface various in radial distance from said arm axis so that said spring acts on said lever at a radial distance with respect to said arm axis that reduces as said door moves in a opening direction.

Preferably said arcuate surface is configured so that torque applied to said lever is substantially constant.

BRIEF DESCRIPTION OF THE DRAWINGS

A preferred form of the present invention will now be described by way of example with reference to the accompanying drawings wherein.

DETAILED DESCRIPTION OF THE PREFERRED EMBODIMENTS

Figure 1:
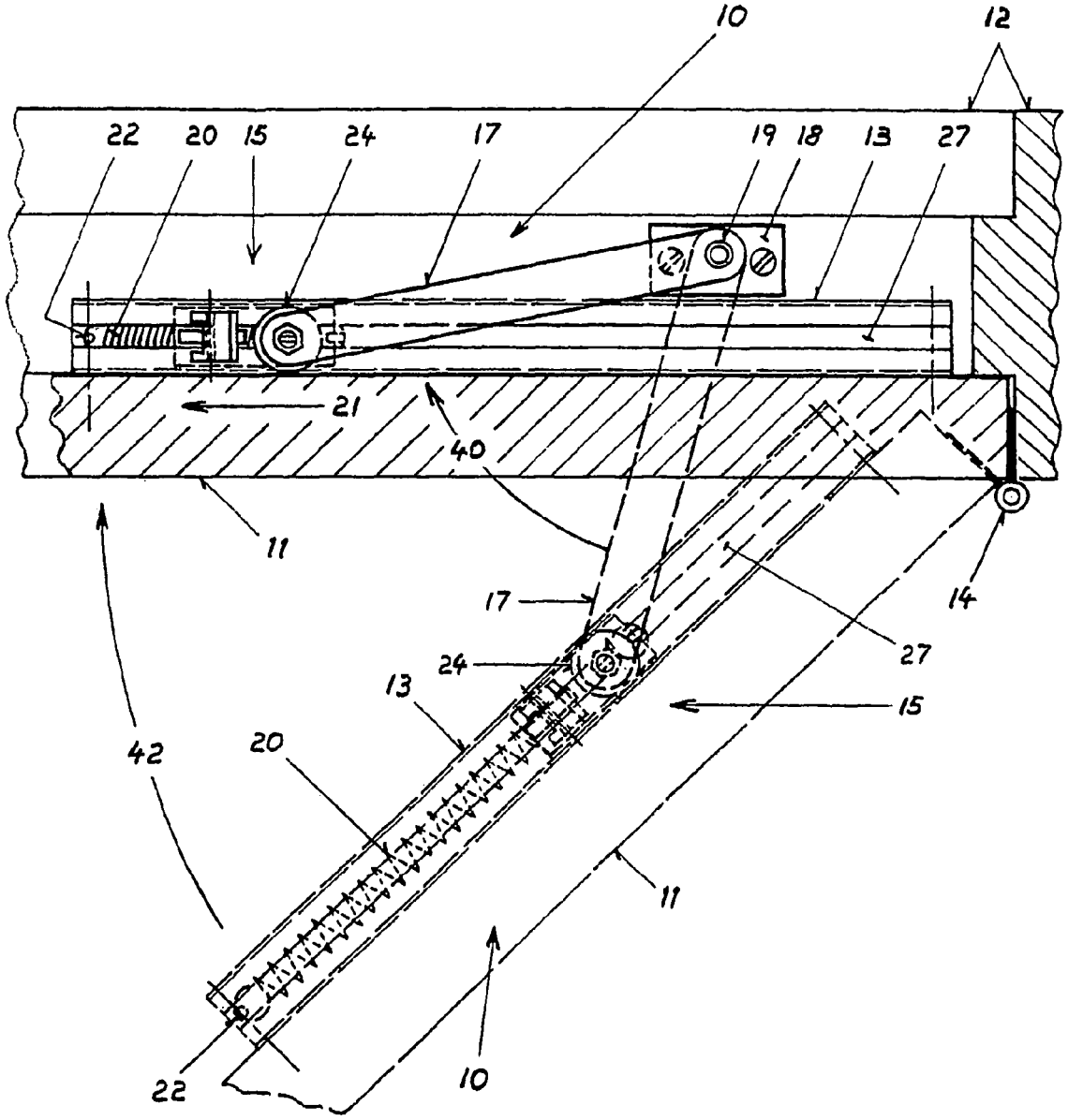
FIG. 1 is a schematic bottom plan view of a mechanical door closer mounted on a door and door jamb.
Figure 2:
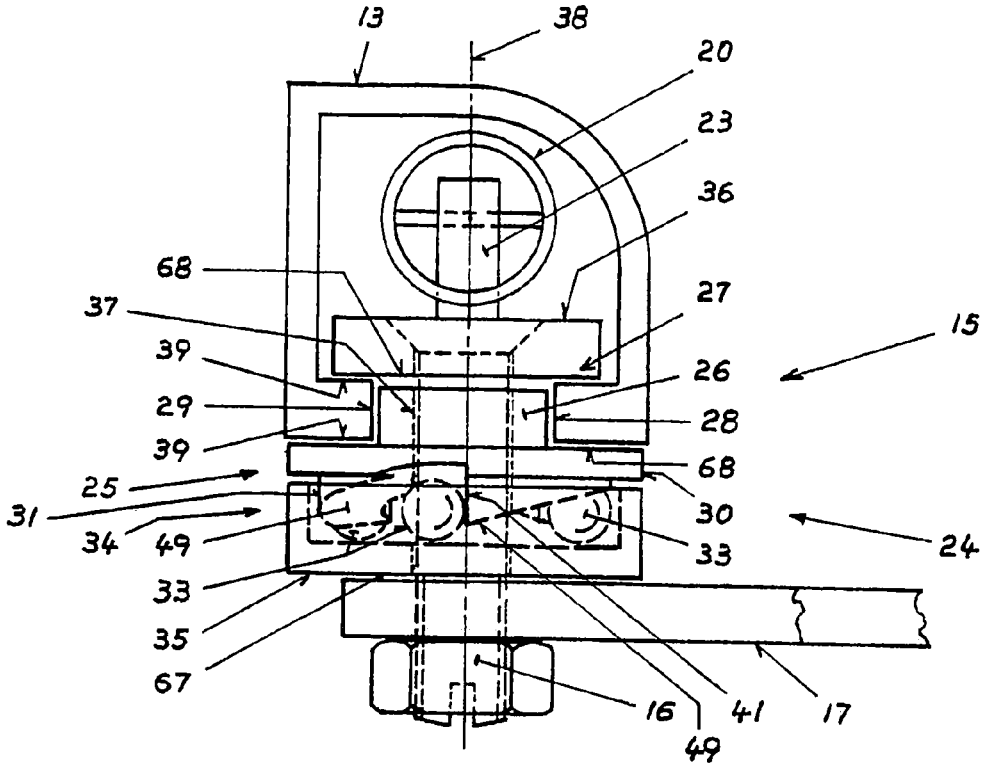
FIG. 2 is a schematic end elevation of a portion of the mechanical door closer of claim 1.
Figure 3:
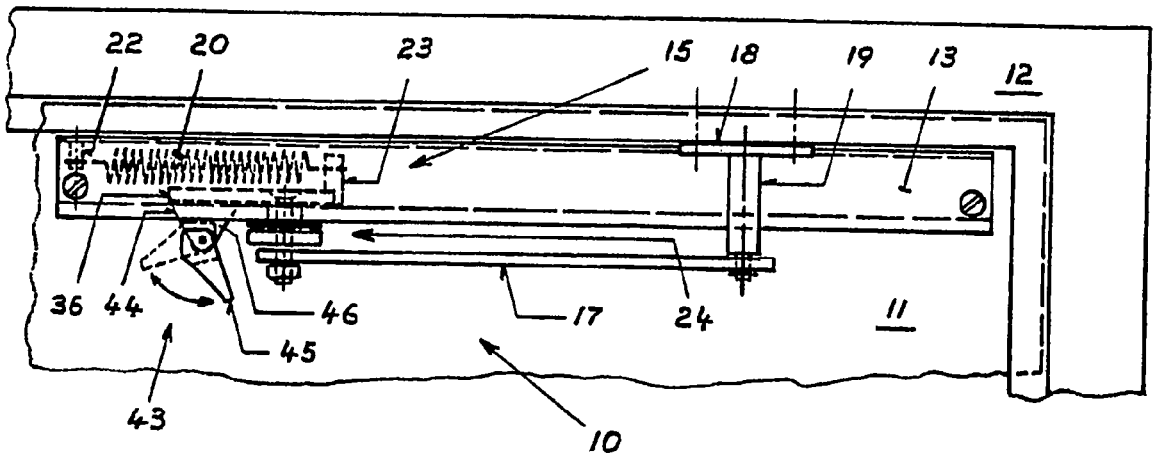
FIG. 3 is a schematic front elevation of the mechanical door closer, door and doorjamb of FIG. 1.
Figure 4:
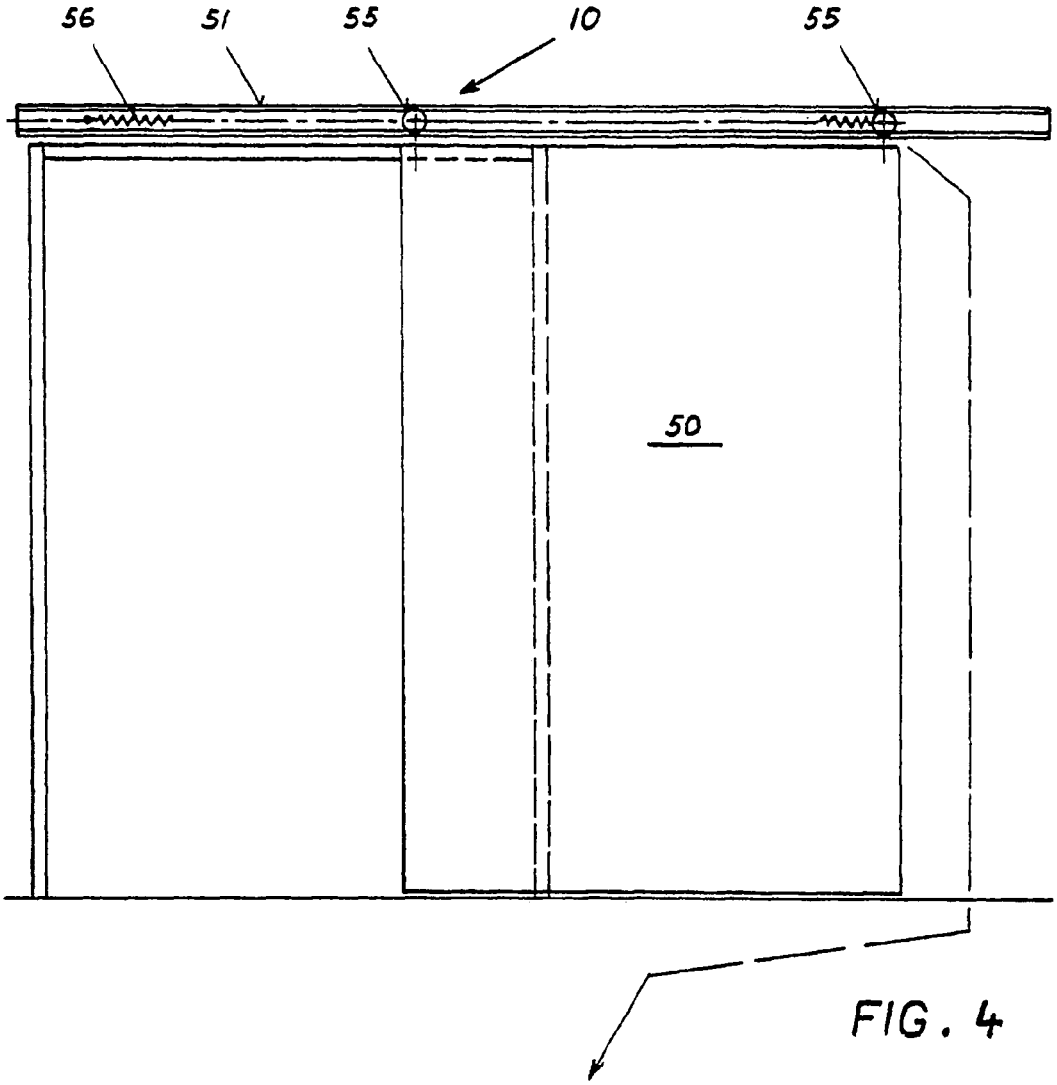
FIG. 4 is a schematic front elevation of a mechanical door closer of FIG. 1 mounted on a sliding door.
Figure 5:
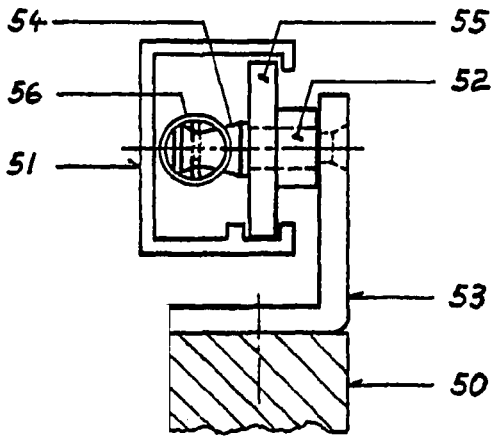
FIG. 5 is a schematic end elevation of a portion of the mechanical door closer, door and door jamb of FIG. 4.
Figure 6:
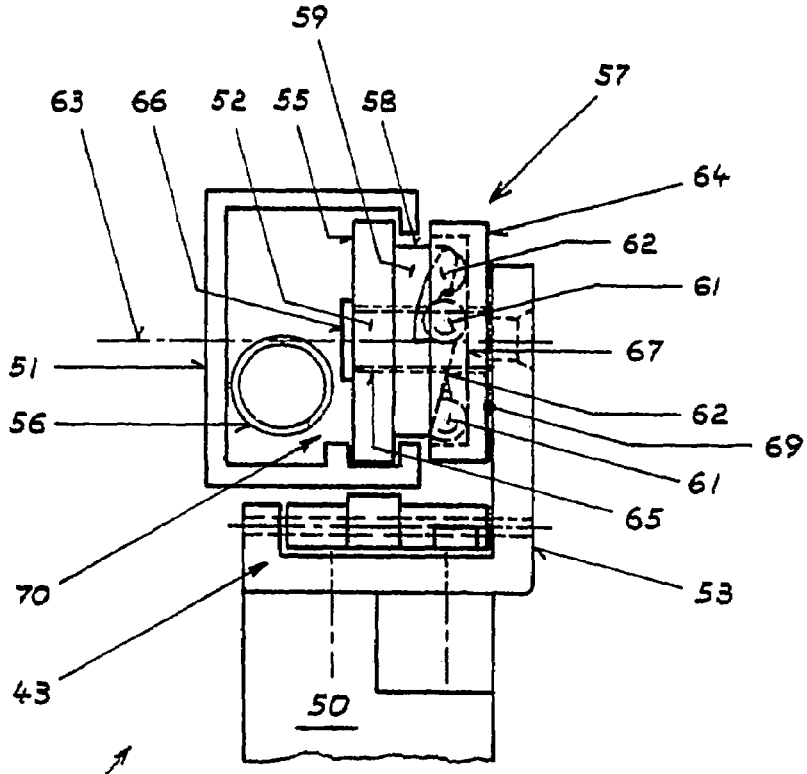
FIG. 6 is a schematic end elevation of portion of the mechanical door closer of FIG. 4.
Figure 7:
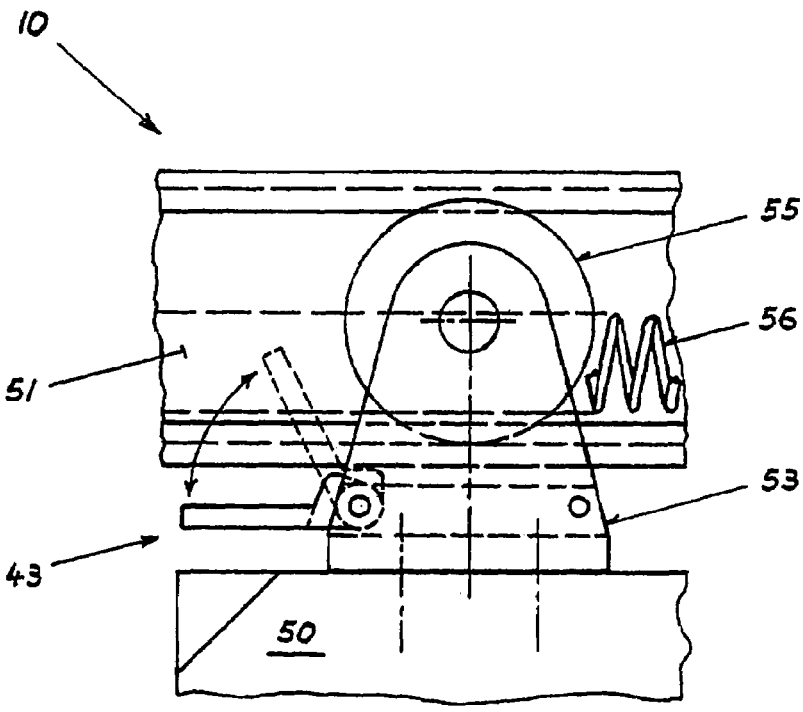
FIG. 7 is a schematic side elevation of portion of the door and mechanical door closer of FIG. 4.

In FIGS. 1 to 3 and of the accompanying drawings there is schematically depicted a mechanical door closer 10 mounted on a pivotally mounted door 11. The door 11 is attached to a doorjamb 12, with the mechanical door closer 10 being configured to urge the door 11 to a closed position with respect to the doorjamb 12.

In respect of FIG. 1 it should be appreciated that the door closer 10 and associated door 11 are illustrated in two positions, a closed position and a partly opened positioned.

The door closer 10 includes an elongated track 13 attached to the door 11 so as to be generally horizontally extending, that is perpendicular to the pivoting axis provided by the door hinge 14. Mounted on the track 13 for movement there along is a carriage 15. The carriage 15 has a central bolt (axle member) 16 that pivotally attaches an arm 17 (connecting member) to the carriage 15. The arm 17 extends to an attachment plate 18, which plate 18 via pin 19 pivotally attaches the arm 17 to the door jamb 12 so that either arm pivots about an axis provided by the pin 19. The carriage 15 has attached to it a biasing member in the form of a coil spring 20 that when tensioned urges the carriage 15 to move in the direction of the arrow 21, that is a direction to cause pivoting of the door 11 to the closed position. The spring 21 has one end attached to a pin 22 fixed to the track 13, and another end attached to a pin 23 of the carriage 15.

The carriage 15 includes a brake assembly 24 that restrains operation of the door closer 10 when moving the door 11 to the closed position. More particularly the brake assembly 24 governs the rate at which the door 11 is moved to the closed position. The brake assembly 24 includes a first brake part in the form of a brake hub 25. The hub 25 has a cylindrical portion 26 that projects into a slot 27 of the track 13. The slot 27 is located between two linear generally horizontally extending surfaces 28 and 29. The hub 25 further includes a brake disc 30 from which there extends a ramp projection 31. The ramp projection 31 provides a plurality of angularly and axially extending ramp surfaces 49. Received by each surface 49 is a rotatable member which in this embodiment is a spherical ball 33. Each ramp surface 49 extends through an angle 71 of about 120°.

Preferably each surface 49 also extends radially from a radially inner end provided by a surface 41.

Cooperating with the hub 25 is a second brake part in the form of a brake shell 34. The shell 34 has a circular end wall 35 and side wall 32 which retain the balls 33 in position against the ramp surfaces 49. The wall 35 provides a brake surface 67.

As is best seen in FIG. 2 the upper end of the bolt 16 has a brake member 36, located internally of the track 13. The bolt 16 passes through an aperture in the arm 17, a passage 37 extending longitudinally through the hub 25, and finally through an aperture in the member 36. The member 36 is elongated so that it cannot rotate. However it should be appreciated that these various components are not "clamped" together and that there is provided a gap permitting relative movement between the member 36 and the disc 30 along the axis 38 of the bolt 16. The disc 30 and member 36 each have a brake surface 68.

In operation of the above described assembly 24 the disc 30 and member 36, via surfaces 68, engage longitudinally extending surfaces 39 of the track 13 to control the rate at which the door 11 is allowed to close. This frictional (braking) engagement of the surfaces 68 with the surfaces 39 is caused by relative angular movement between the shell 34 and hub 25. In this respect it should be appreciated that the shell 34 will generally move with the arm 17 due to contact therewith.

When the door is moved from the closed position in an opening direction the arm 17 pivots in the opposite direction to the arrow 40. The carriage 15 slides along the track 13 in a direction opposite to the arrow 21, and tensions the spring 20. It should also be appreciated that due to forces applied to the arm 17 by the carriage 15, the cylindrical portion 26 of the hub 25 is urged into engagement with the surface 28. This rotates the hub 25 in a direction to maximise the displacement between the disc 30 and member 36. Accordingly there is little or at least minimum frictional contact of the surfaces 68 with the surfaces 39. Essentially the balls 33 abut end surfaces 41.

When the door 11 is in an open position and released to move in the direction of the arrow 42 under the influence of the tensioned spring 20, the braking assembly 24 controls the rate at which the door 11 closes. More particularly forces apply to the carriage 15 by the arm 17 cause the cylindrical portion 26 to engage the surface 28. This frictional engagement causes rotation of the hub 25 so that the balls 33 move along the inclined ramp surfaces 49. This movement of the balls 33 causes the hub 25 to push the shell 34 away (that is separate the hub 25 and shell 34) and therefore bring surfaces 68 into increased frictional contact with the surfaces 39. In that regard it should be appreciated that the passage 37 provides for sliding movement of the hub 25 along the bolt 16.

As the frictional contact between the surfaces 68 and 39 increases, the inertia of the door 11 will cause the door 11 to essentially push on the arm 17 and move the cylindrical portion 26 away from the surface 28 and into contact with the surface 27. This will then angularly move the hub 25 to position the balls 33 to reduce the force being applied to the surfaces 68 and 39. Thus the braking force is reduced. The door 11 will again be accelerated by the spring 20 until the arm 17 again causes the cylindrical portion 26 to engage the surface 28 as discussed above. This cycle is repeated while the door 11 continues to move to the closed position. Accordingly, the speed at which the door 11 closes is controlled. The speed at which the door 11 closes can also be adjusted by changing the length/spring rate of the spring 20. Alternatively the speed can be adjusted by altering the maximum gap between the hub 25 and shell 34.

In addition to frictional contact between surfaces 68 and 39 there is also frictional contact between the surface 67 and arm 17 which aids in restraining movement of the door 11. This frictional contact between the surface 67 and arm 17 is enhanced when the surfaces 68 are being urged into contact with the surfaces 39.

Mounted on the brake member 36 is a cam lock 43 that is operable to fix the carriage 15 in a desired position and therefore retaining the door 11 in a desired location, such as completely open. The cam lock 43 includes a flange 44 attached to the brake member 36. The flange 44 has attached to it a cam lever 45 that has a cam portion 46 to engage the track 13. Pivoting movement of the lever 45 engages the cam portion 46 with the track 13 to retain the carriage 15 in a fixed desired position. Reverse pivoting of the lever 45 releases the cam lock 43 and permits the door 11 to move to a closed position. The cam lock 43 can also be released by moving the door 11 in the open direction.

In FIGS. 4 to 7 of the accompanying drawings there is schematically depicted the door closer 10 modified to close a sliding door 50. The door 50 is mounted on a track 51 by means of rollers 55. Each roller 55 is supported by means of axle 52 attached to a bracket or arm (connecting member) 53 secured to an upper surface of the door 50. One of the rollers 55 has a post 54 to which there is attached a spring 56 also attached to the track 51. When the door 50 is moved to an open position the spring 56 is tensioned urging the door 50 to move to a closed position.

To control the rate at which the door 50 closes there is provided a brake assembly 57 which is part of a carriage 70. The assembly 57 includes a first brake part in the form of a hub 58 providing one of the rollers 55. The hub 58 also has a ramp projection 59 having a plurality of angularly, radially and axially extending ramp surfaces 62. Engaging each surface 62 is a spherical ball 61. Each ramp surface 62 extends angularly, axially and radially relative to the axis 63. Associated with the ramp projection 59 is a second brake part in the form of a brake shell 64. The shell 64 has an end wall against which the balls 61 engage, the end wall providing a brake surface 69.

The brake assembly 57 includes an axle 52 that passes through a passage 65 in the hub 58, and through an aperture in the shell 64. The axle 52 terminates with a flange 66 against which the hub 58 is abutted.

In operation of the above described assembly 57, when the door 50 is being moved to the open position the balls 61 are urged into contact with end surfaces 67 so that the shell 64 can move longitudinally of the axis 63 relative to the hub 58. Accordingly there is no braking force applied. However when the door 50 is moving to a closed position frictional contact between the shell 65 and bracket 53 causes the balls 61 to move along the ramp surfaces 62 due to rotation of the roller 55. As the balls 61 move along the ramp surfaces 62 the surface 69 is urged into contact with the bracket 53 thereby applying a frictional force thereto. This then inhibits rotation of the roller 55 and slows the rate at which the door 50 is being closed.

There is also provided a cam lock 43 as previously discussed.

Figure 8:
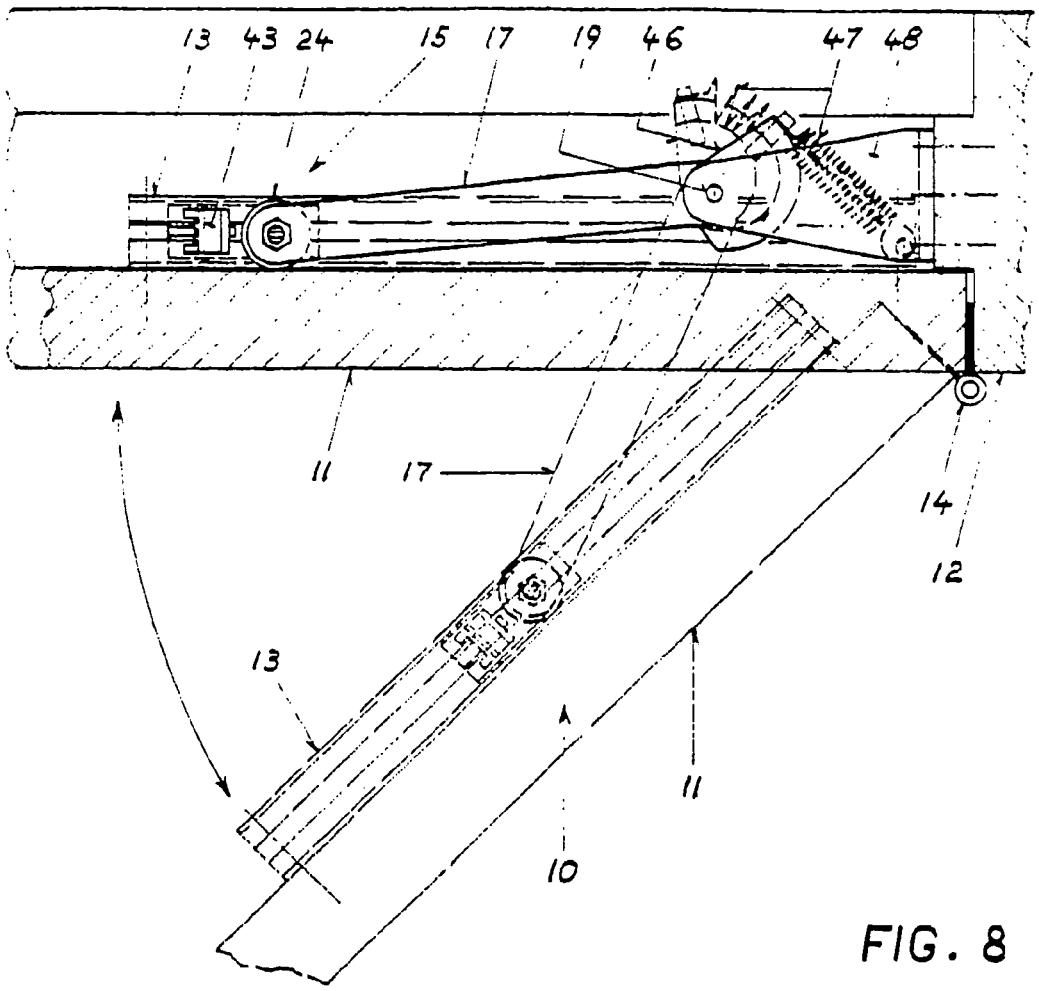
FIG. 8 is a schematic bottom plan view of a modification of the door closer of FIG. 1, doorjamb and pivotally mounted door.
Figure 9:
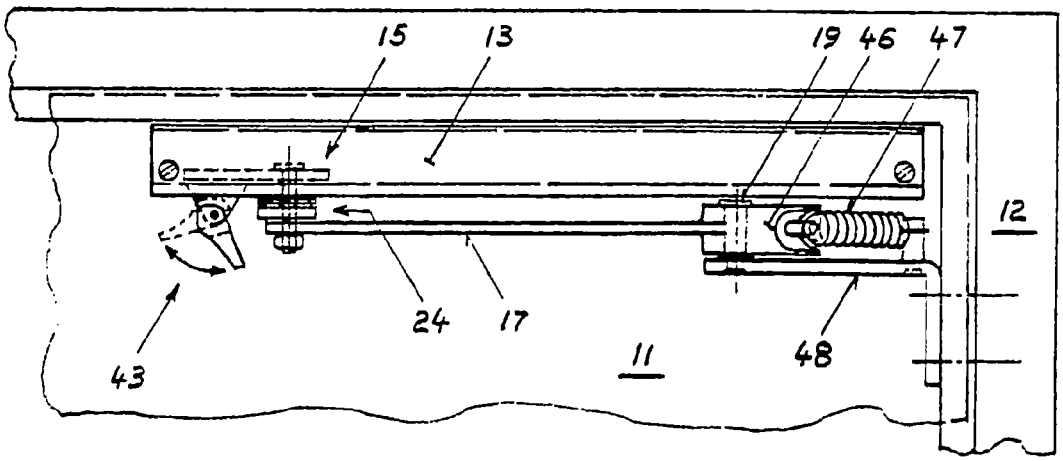
FIG. 9 is a schematic side elevation of the mechanical door closer, door and doorjamb of FIG. 8.
Figure 10:
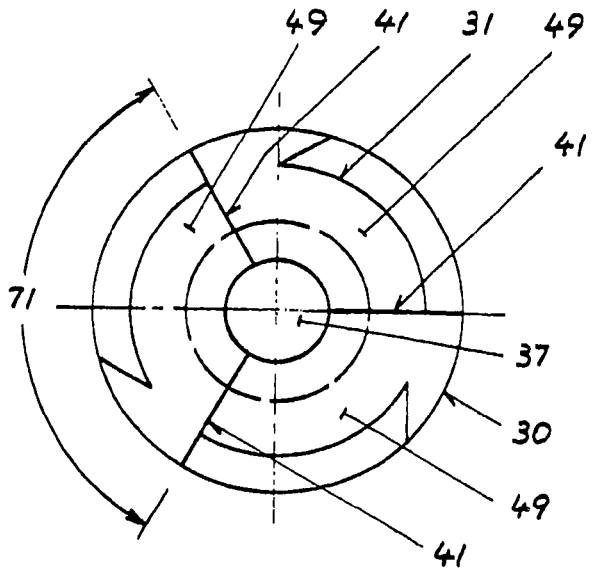
FIG. 10 is a schematic plan view of a hub employed in the mechanical door closer of FIG. 1.
Figure 12:
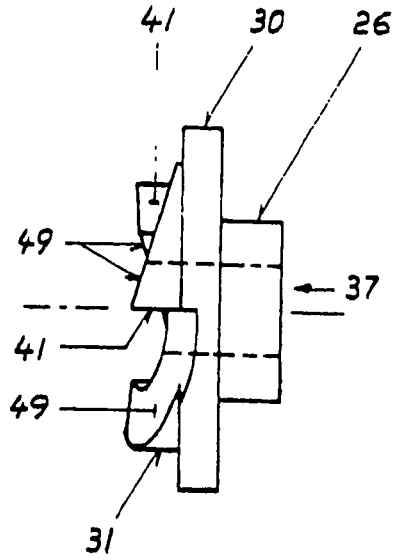
FIG. 12 is a schematic side elevation of the hub of FIG. 10.
Figure 11:
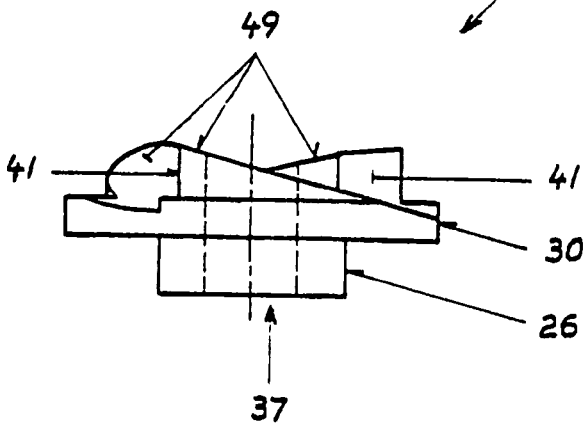
FIG. 11 is a schematic front elevation of the hub of FIG. 10.

In FIGS. 8 and 9 there is schematically depicted a modification of the door closer 10 of FIG. 1. In this embodiment there is no spring 20 located in the track 13. However there is provided an arcuate lever 46 attached to the arm 17. Extending from and fixed to the lever 46 is an elongated coil spring 47 having one end fixed to a bracket 48. The lever 46 has an arcuate slot (surface) within which the spring is located as the lever 46 pivots. The slot varies in radial distance from the pin 19 so that as the door 11 moves toward the open position the spring 47 acts at a reducing radius. This compensates for the increase in the force applied by the spring 47 so that the torque applied to the arm 17 is substantially constant That is the slot reduces the distance from the pin 19 at which the spring 47 acts. The lever 17 is pivotally mounted on the bracket 48 directly attached to the door jamb 12. The door 11 is urged to the closed position by tensioning the spring 17. This occurs when the door 11 is moved to the open position.

In a further modification the spring 47 may be replaced with or used in conjunction with a spiral spring wound about the pin 19 and engaging the arm 17 and bracket 48 to urge the arm 17 to move the door 11 to the closed position. In a further modification the embodiments of FIGS. 1 to 3 could be combined with the embodiment of FIGS. 8 and 9.

The claims defining the present invention are as follows:

1. A mechanical door closer to extend between a door and an associated door jamb to urge the door to a closed position with respect to the door jamb, said closer including:

an elongated track to be fixed to the door or door jamb;

a carriage mounted on the track for movement there along;

a connecting member attached to the carriage and extending therefrom to attach the carriage to the door jamb if the track is attached to the door, or to attach the carriage to the door if the track is attached to the door jamb, so that movement of the door in a closing direction causes movement of the carriage in a predetermined direction;

a biasing member urging said carriage to move in said predetermined direction along the track and wherein said track and connecting member are intended to be attached to the door and door jamb so that upon opening movement of the door said carriage is caused to move along said track in a direction opposite said predetermined direction; and wherein said carriage includes a brake mechanism to restrain movement of said carriage in said predetermined direction, said brake mechanism having:

a first brake part, said first part being mounted for rotational movement about an axis transverse of said track and having at least one ramp surface extending angularly and axially with respect to said axis, said first part being engaged with said track to cause rotation of said first part in a predetermined angular direction when said carriage is moved in said predetermined direction along said track;

at least one rotatable element, each said rotatable element being engaged with a respective one of said at least one ramp surface;

a second brake part, said second part being mounted adjacent said first part and having a surface to engage said element;

a first brake surface;

a further brake surface, said further brake surface being adjacent said first brake surface; and wherein relative angular movement between said first and second parts by rotation of said first part in said predetermined angular directions causes each said rotatable element to move along said respective ramp surface to separate said first and second parts axially and move said first brake surface against said further brake surface so that a friction force is applied to said first and further brake surfaces to restrain movement of said carriage in said predetermined direction.

2. The closer of claim 1 wherein said second brake part retains each said rotatable element respectively in position with respect to each said respective ramp surface.

3. The closer of claim 1 wherein said first part has a plurality ramp surfaces, and a rotatable element cooperating with each ramp surface and engaged with said second part surface to cause the separation of the first and second parts.

4. The closer of claim 1, wherein each ramp surface also extends radially relative to said axis.

5. The closer of claim 4 wherein each ramp surface is inclined to said axis by an angle, said angle being between 12° and 20°.

6. The closer of claim 5 wherein said angle is about 16°.

7. The closer of claim 1 wherein said track is adapted to be attached to said door and said connecting member is an arm, said arm being pivotally attached to said carriage, and adaptably to be pivotally attached to said jamb for pivoting movement about an arm axis.

8. The closer of claim 7 wherein said biasing member is a spring that is tensioned upon movement of said carriage in said opposite direction.

9. The closer of claim 8 wherein said spring is elongated and has a first extremity attached to said track and a second extremity attached to said carriage.

10. The door closer of claim 7 further including:

a lever fixed to said arm for said pivoting movement therewith about said arm axis, and wherein said spring is an elongated coil spring and said lever has an arcuate spring engaging surface from which said spring extends, said arcuate spring engaging surface various in radial distance from said arm pivot axis so that said spring acts on said lever at a radial distance with respect to said arm axis that reduces as said door moves in a opening direction.

11. The door closer of claim 10 wherein said arcuate spring engaging surface has radial distance from said arm axis so that torque applied to said lever is substantially constant during said pivoting movement.

12. The closer of claim 1 wherein said track has a longitudinally extending slot defined between longitudinal surfaces, said longitudinal surfaces being provided to engage said first part and said first part has a generally cylindrical portion positioned to engage said longitudinal surfaces so that upon engagement of said cylindrical portion with a first one of said longitudinally surfaces said first part is caused to rotate in said predetermined angular direction.

13. The closer of claim 12 wherein said first part has said first brake surface and said carriage includes a brake member providing said further brake surface with said brake member being operatively associated with said second part so that, upon said move to separate said first and second parts said first and further brake surfaces are urged into friction engagement with said track.

14. The closer of claim 13 wherein said second brake surface is located internally of said track and said first brake surface is located externally of said track.

15. The closer of claim 13 wherein said carriage includes an axle member securing the carriage to said arm and upon which said second and first parts are mounted for angular movement thereabout, with said axle member providing said axis.

16. The closer of claim 1 wherein said door closer is adapted to be attached to a sliding door, said track is to be fixed to the door jamb and said carriage includes a roller fixed to said first brake part to cause the rotation thereof, and engaged within said track, and said connecting member is adapted to be attached to said door so that the door is supported on said roller.

17. The closer of claim 16 said roller is part of said first part.

18. The closer of claim 1 said biasing member is a spring operatively associated with said arm to urge said arm to move said carriage in said first direction.

19. The closer of claim 18 said spring is a coil spring.

20. The closer of claim 18 wherein said spring is a spiral spring.

* * * * *